US006817383B2

(12) United States Patent
Debaes et al.

(10) Patent No.: US 6,817,383 B2
(45) Date of Patent: Nov. 16, 2004

(54) WEAVING MACHINE AND METHOD FOR WEAVING FABRICS WITH PILE LOOPS

(75) Inventors: Johny Debaes, Moorslede (BE); Gilbert Moulin, Rekkem (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 10/394,659

(22) Filed: Mar. 24, 2003

(65) Prior Publication Data

US 2003/0226613 A1 Dec. 11, 2003

(30) Foreign Application Priority Data

Mar. 22, 2002 (BE) ..... 2002/0210

(51) Int. Cl.[7] ..... D03D 39/16

(52) U.S. Cl. ..... 139/21; 139/37; 139/102; 139/116.5

(58) Field of Search ..... 139/21, 37, 102, 139/116.5

(56) References Cited

U.S. PATENT DOCUMENTS

| | | | | |
|---|---|---|---|---|
| 2,060,502 A | | 11/1936 | Kaufman | |
| 2,108,046 A | | 2/1938 | Drobile | |
| 3,289,706 A | | 12/1966 | Valentine | |
| 3,327,738 A | * | 6/1967 | Jan | 139/398 |
| 5,400,831 A | * | 3/1995 | Gheysen | 139/21 |
| 5,522,435 A | * | 6/1996 | DeRudder | 139/65 |
| 5,615,712 A | * | 4/1997 | Derudder et al. | 139/21 |
| 6,000,442 A | * | 12/1999 | Busgen | 139/389 |

FOREIGN PATENT DOCUMENTS

| | | |
|---|---|---|
| BE | 1010423 | 7/1998 |
| DE | 4243237 | 8/1994 |
| DE | 4312235 | 10/1994 |
| EP | 0 974690 | 1/2000 |
| JP | 53147859 | 12/1978 |
| JP | 54147263 | 11/1979 |

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A face-to-face weaving machine comprising upper (5) and lower spacers (6) for extending in the warp direction between two fabrics (12), (13) and a weft insertion device (2), (3), (4) for inserting weft yarns (22) between the spacers (5), (6), said spacers being carried out as a rigid element with a first (5*c*), (6*c*) and a second part (5B), (6B), the vertical intermediate distance between the first parts (5*c*), (6*c*) of the spacers (6) being shorter than said distance between the second parts (5B), (6B) such that the weft yarns (22) can be inserted between said second parts (5B), (6B).

7 Claims, 7 Drawing Sheets

FIG, 7
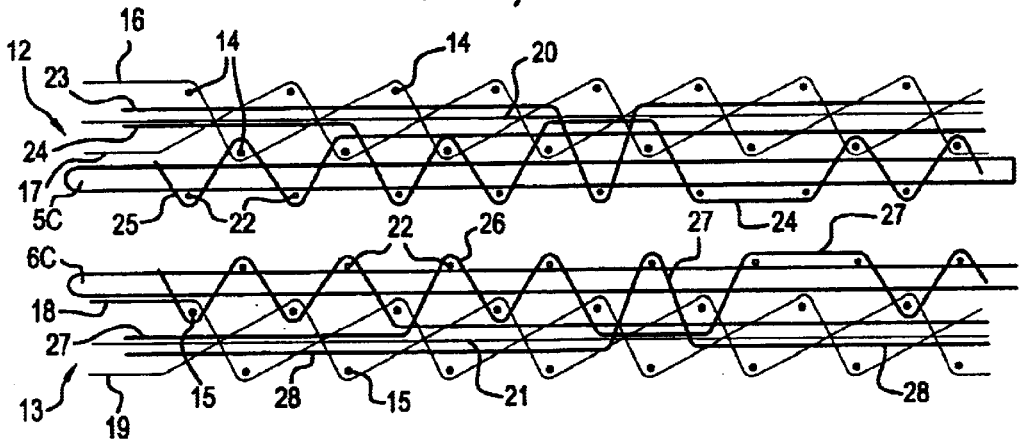
FIG, 8
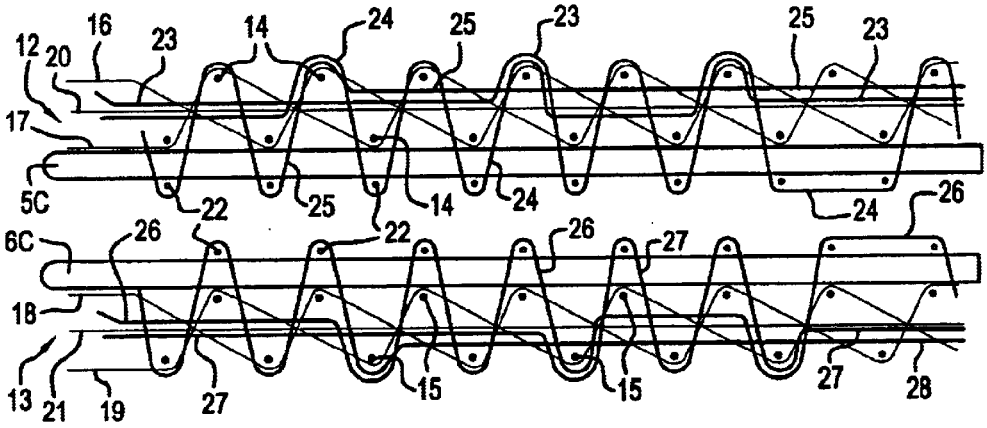
FIG, 9
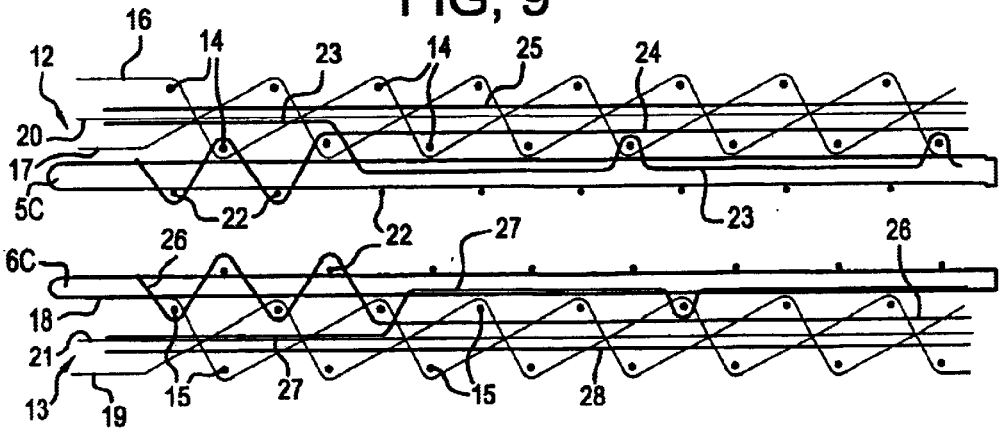

WEAVING MACHINE AND METHOD FOR WEAVING FABRICS WITH PILE LOOPS

This application claims the benefit of Belgian Application No. 2002/0210 filed Mar. 22, 2002.

SUMMARY OF THE INVENTION

This invention relates to a face-to-face weaving machine provided to form a shed between warp yarns during successive weft insertion cycles and each time to insert one or more weft yarns into this shed, so that two backing fabrics may be woven simultaneously above one another, this weaving machine comprising upper and lower spacers, which are provided in order to extend between the said backing fabrics in the warp direction during weaving and this weaving machine comprising a weft insertion device provided in order to insert weft yarns between the upper and lower spacers.

More particularly, the present invention relates to a face-to-face weaving machine, which has been designed for weaving simultaneously two fabrics with pile loops. More particularly, it deals with a face-to-face weaving machine equipped with a four-position jacquard machine.

The present invention likewise relates to a method for weaving fabrics with pile loops, in which each time at least three weft yarns are inserted above one another at a respective insertion level during successive weft insertion cycles on a face-to-face weaving machine, an upper and a lower backing fabric being woven from respective backing warp yarns and backing weft yarns, first and second loop weft yarns being inserted between the two backing fabrics and being kept at a distance from the two backing fabrics, first pile warp yarns being alternately interlaced in the upper backing fabric and forming a pile loop over at least one first loop weft yarn, second pile warp yarns alternately being interlaced in the lower backing fabric forming a pile loop over at least one second loop weft yarn and the first and second loop weft yarns being subsequently removed, so that two fabrics with pile loops are being woven at the same time.

More particularly, the present invention relates to a method for weaving carpets having one or more zones with pile loops at the face being used as well as one or more zones with a cut pile and/or one or more zones having a ribbed structure (false bouclé fabric) and/or one or more zones with a pile-free effect (where the backing weave is visible) and/or one or more zones with pile warp yarns floating on the pile face (flat weave), the zones with different effects together forming a pre-determined figure or pattern.

More particularly the present invention relates to a method carried out by means of a face-to-face weaving machine according to the present invention described in this patent application.

Of course, the present invention also relates to the fabrics and more particularly to the multicoloured carpets manufactured according to a similar method.

In the European patent application with publication number EP 0 974 690 a face-to-face weaving machine is described having the characteristics indicated in the first section of this description. This machine has upper and lower lancets in order to keep the loop weft yarns at a distance from the backing fabrics. During each weft insertion, a weft yarn is inserted between the two lancets.

With this type of machines, however, the weft insertion is carried out by a set of rapiers moving between the lancets. Then the vertical distance between the upper and the lower lancets should be sufficiently long to allow the rapiers to pass freely. The distance between the lancets and the respective backing fabrics determines the loop height. With these weaving machines, the loop height should be kept limited, so that sufficient space should be available for the rapiers to move. It is a purpose of this invention to remedy this drawback.

This purpose will be attained by providing a face-to-face weaving machine designed to form a shed between the warp yarns during the successive weft insertion cycles and each time to insert one or more weft yarns into this shed, so that two backing fabrics may be woven simultaneously one above the other, this weaving machine comprising upper and lower spacers, designed to extend between the said backing fabrics in the warp direction during weaving, this machine comprising a weft insertion device designed to insert weft yarns between the upper and lower spacers, and the weaving machine according to the present invention comprising spacers carried out in such a manner that they have a first part to form loops and a second part linking up with it, and shaped such that the vertical intermediate distance between the first parts of the upper and the lower spacers is shorter than the vertical intermediate distance between the second parts of the upper and lower spacers, and further also comprising a weft insertion device designed to insert weft yarns between the said second parts of this rigid elements.

Preferably, the longer vertical intermediate distance between the said second parts is obtained because the spacers are carried out with a bend. Then the first parts (preferably the end parts) are situated between the rulers of the weaving machine, while the said second parts are situated where the shed is formed and where the weft yarns are inserted.

In such an embodiment, sufficient space is available between the second parts of the spacers to allow a weft insertion means, such as for instance a rapier, to pass freely. The loop height is determined by the first parts of the spacers. Even when the vertical distance between these first parts is rather short, the vertical distance between the second parts may be sufficient to allow the weft insertion means to pass freely. Because of this, greater loop heights may be realized.

As clearly appears from the preceding pages, such a face-to-face weaving machine is particularly suitable for weaving fabrics with pile loops according to the present invention. Because of this, fabrics with pile loops can be produced at a high productivity and at a great weaving speed. Moreover, it is possible, within a same method and on the same weaving machine, to obtain fabrics with a large number of different effects, allowing fabrics to be produced, the pile face of which will show a wide variety.

Preferably, the spacers are designed to keep the weft yarns, inserted between them, at a distance from the respective backing fabrics, while the said first parts for forming loops comprise at least two parts of a different height, so that the said distance may be modified. By shifting the spacers (in the warp direction) another part of the spacers may be used and in doing so, the height of the pile loops may be modified.

In order to support the upper spacers the weaving machine may be equipped with a stationary weaving frame.

If the weft insertion device of this weaving machine is designed to insert at least three weft yarns at the different insertion levels during successive weft insertion cycles, during each cycle, a loop weft yarn and a backing weft yarn for each backing fabric are inserted. In this manner, fabrics with pile loops may be manufactured in a very productive manner.

In a particular embodiment, at least one upper and/or at least one lower spacer comprises a cutting device in order to cut through weft yarns inserted between the upper and lower spacers.

In a very preferred embodiment, this face-to-face weaving machine is designed to weave two fabrics with pile loops and a cut pile simultaneously. Preferably, this occurs according to a method according to the present invention, as described hereafter in the patent application.

In a most preferred embodiment, this weaving machine is provided with a four-position jacquard machine, preferably an open-shed-four-position jacquard machine.

In the European patent publication EP 0 974 690 a method is also described, according to which two loop pile fabrics are woven simultaneously on a face-to-face weaving machine where each time three weft yarns are inserted above one another per weft insertion cycle. Two backing fabrics are woven above one another from warp yarns and weft yarns, while loop weft yarns, by means of upper and lower lancets, are kept at a distance from these backing fabrics. Pile warp yarns are interlaced in alternately in a backing fabric and bent over a loop weft yarn. Afterwards, the loop weft yarns are removed, so that two fabrics with loop forming pile warp yarns are formed. This method has the characteristics, which were mentioned, in the third section of this description.

The fabrics realized according to this method have a pile exclusively consisting of pile loops. In other words, the structure of the pile shows no variation at all.

It is likewise a purpose of the present invention to provide for such a method, by means of which the said drawback can be remedied and by means of which therefore two pile loop fabrics can be woven simultaneously at a high productivity having a pile structure showing a greater variety than the pile loop fabrics known.

According to the present invention, this purpose is attained by providing for a method for weaving fabrics with pile loops, where on a face-to-face weaving machine, during successive weft insertion cycles, each time at least three weft yarns are inserted at a respective insertion level above one another, an upper and a lower backing fabric being woven from respective backing warp yarns and backing weft yarns, first and second loop weft yarns being inserted between the backing fabrics and being kept at a distance from the two backing fabrics, first pile warp yarns being interlaced in in the upper backing fabric and forming a pile loop over at least one first loop weft yarn alternately, second pile warp yarns being interlaced in in the lower backing fabric and forming a pile loop over at least one second loop weft yarn alternately, the first and second loop weft yarns being subsequently removed, so that two fabrics with pile loops are woven simultaneously, and where, according to the present invention, a number of pile warp yarns are interlaced in in the upper and the lower backing fabric alternately and afterwards being cut between the two backing fabrics, so that on both fabrics also at least one zone with a cut pile is obtained.

Because of the combination of two different structures in the pile—pile loops and a cut pile—fabrics are obtained with an aspect which shows much more variety than the fabrics woven according to the methods known. Because, weaving is carried out according to a face-to-face weaving method, a high productivity is attained. For instance, with a threefold weft insertion, a weft yarn is inserted between the spacers, each time at the middlemost insertion level, while a backing weft yarn is inserted at the upper and lower insertion level for the upper and the lower fabric respectively.

An additional advantage of this method is that it allows for pile loops as well as for a cut pile to be formed in a fabric with the same weaving machine without any shifting or modification of the adjustments.

Preferably, one or several zones with a cut pile and one or several zones with pile loops being determined thus that a certain figure or pattern in the fabric is obtained. Therefore, also texts and logograms can be obtained in the fabric, for example, and this both on the face to be used and on the back of the fabric.

When applying this method, preferably use is made of a four-position-jacquard machine and more particularly of such a machine enabling to function according to the open-shed principle. If a threefold weft insertion (with three weft insertion means functioning above one another) is applied, it should be possible to insert the pile warp yarns in the following four positions:

above the upper insertion means, between the upper and the middlemost insertion means, between the middlemost and the lower insertion means, and below the lower insertion means.

When carrying out this method, both a cut pile and pile loops can be formed by means of a number of pile warp yarns (this is shown in FIG. 6 for pile warp yarns (24) and (26).

With the method according to the present invention, it is likewise possible in a number of warp yarn systems to make a first and a second pile warp yarn together form a cut pile over the same weft yarns in order to create pile points with a double pile, while for at least one zone of the fabrics the proportion between the number of pile points with a double pile and the number of pile points with one single pile is determined as a function of the pile density desired.

When pile warp yarns of a particular colour are used to form pile loops and to form a cut pile, it is necessary to provide two pile warp yarns of that particular colour if the possibility of forming pile loops of that colour in the upper and in the lower backing fabric simultaneously is required. For instance, these two pile warp yarns of the same colour running together may be used in a number of warp yarn systems in order to form a cut pile over the same weft yarns. Thus, pile points with a double pile are obtained in a zone with a cut pile. Now, by not always carrying through these double pile points in a cut pile zone, but only for a fraction of the pile points, it is possible to realize a pile density that will be between 100% (all pile point single pile) and 200% (all pile points double pile). All intermediate values (between 100% and 200%) of pile density are possible by choosing a suitable proportion between the number of pile points with a double pile and the number of pile points with one single pile.

According to a preferred embodiment, according to the present invention, the upper and lower spacers are carried out as rigid elements and extending in the warp direction, are provided between the said backing fabrics, and the said first and second loop weft yarns are inserted between upper and lower spacers, because of which they are kept at a distance from the upper and lower backing fabric respectively.

Preferably, these spacers are carried out as flat lancets of a limited thickness, the flanks of which extend between the upper and the lower fabric, almost vertically next to one another, and in their longitudinal direction according to the warp direction. The distance between the lower edge of the upper lancets and the upper backing fabric determining the height of the pile loops being formed on the upper fabric.

The distance between the upper edge of the lower lancets and the lower backing fabric determining the height of the pile loops being formed on the lower backing fabric.

Preferably, the said spacers are carried out in such a manner that they have a first part for forming loops and a second part linking up with it, that the vertical intermediate distance between the first parts of the upper and the lower spacers is shorter than the vertical intermediate distance between the second parts of the upper and the lower spacers, while the said weft insertion device is designed to insert weft yarns between the said second parts of these rigid elements.

In the method according to the present invention preferably, each time a backing weft yarn for the upper backing fabric, a backing weft yarn for the lower backing fabric and a first and a second loop weft yarn alternately will be inserted during successive weft insertion cycles.

Further, according to this method, a number of warp thread systems with a first and/or a second loop forming pile warp yarn, also a third pile warp yarn may be provided, which is interlaced in the upper and the lower backing fabric alternately and thereafter will be cut through between the two backing fabrics, so that at least in one fabric a zone with both a cut pile and pile loops is obtained. Because of this, an additional variety of aspect of the fabric can be created during the same weaving process.

When carrying out the method according to the present invention, in at least one fabric, with respect to weft yarns inserted during successive weft insertion cycles, also a third pile warp yarn can be interlaced over a backing weft yarn alternately in order to form cut pile legs, and a first or a second pile warp yarn can form a pile loop over a loop weft yarn, so that in at least one fabric, a zone is obtained with a pile loop and a two cut pile legs alternately. This is yet another possibility (called "cut-loop" weaving) which may be used during the same method in order to bring variety to the aspect of the fabric.

Yet another effect which may be applied when carrying out this method, is the pile-free effect. For that purpose, in at least one zone of at least one fabric all pile warp yarns are woven in, so that the backing fabric is visible from the pile face of the fabric.

Yet another effect is obtained when in at least one of the fabrics a number of pile warp yarns is interlaced alternately in the backing fabric and bent on the pile face over at least one backing weft yarn, so that at least also one zone with a ribbed structure, more particularly with false bouclé, is obtained.

Further, in at least one of the fabrics, also a number of pile warp yarns may be interlaced alternately in the backing fabric and made to run floatingly on the pile face over several backing weft yarns (floating), so that also at least one zone with a flat fabric surface ("flat weave") is obtained.

Preferably, tension warp yarns are provided in the backing fabrics, and dead pile warp yarns are interlaced in one the two backing fabrics either running along with the tension warp yarns or floatingly on the pile face, over one or more backing weft yarns.

In a number of warp yarn systems, also two pile warp yarns may be interlaced in opposite phase in the upper and the lower backing fabric alternately and thereafter be cut through between the two backing fabrics, so that at least one zone with a cut pile is obtained. By applying this so-called "pile weaving in opposite phase", a fabric is obtained with at least one zone where the cut pile has a great pile density.

If tension warp yarns are provided in the backing fabrics, the pile warp yarns can be interlaced over at least one backing weft yarn inserted on the back with respect to the tension warp yarns (so called: woven through the back). In that manner a good pile retention is obtained.

The pile warp yarns can also be interlaced over at least one backing weft yarn, which is inserted, on the pile face with respect to these tension warp yarns. Because of this, the pile yarn consumption can be reduced.

According to a particular method according to the present invention, pile warp yarns are used which will shrink after they have been cut through. Therefore it is possible to obtain a pile height for the cut pile which is smaller than half the distance between the two backing fabrics, so that, for instance, for the cut pile and the pile loops the same pile height can be obtained.

It is obvious that the present invention also relates to fabrics with pile loops, which are manufactured by means of a method according to the present invention and therefore will comprise also at least one zone with a cut pile.

In the following detailed description, a number of weaves according to the present invention and a part of a face-to-face weaving machine are described in a more detailed manner. Its only purpose is to further clarify the principles and the said characteristics and advantages of the invention by means of a number of concrete examples. It may be clear that nothing in this description may be interpreted as a restriction of the scope of the patent rights claimed for in the claims, nor as a restriction of the field of application of the present invention.

In the following description reference is made by means of reference numbers to the attached drawings, of which: the FIGS. 1 to 11 each time represent a schematic cross-section in the warp direction of two fabrics during their being produced according to the present invention on a face-to-face weaving machine equipped with upper and lower lancets, the warp yarns of one warp yarn system, the weft yarns and one upper and one lower lancet being represented in each cross-section, and where,

BRIEF DESCRIPTION OF THE DRAWINGS

In FIG. 7 the production of fabrics with pile loops, not woven through the back and dead pile warp yarns woven in is represented;

In FIG. 8 the production of fabrics with pile loops woven through the back, with pile loops formed over several pile weft yarns and with dead pile warp yarns woven in is represented;

In FIG. 9 the production of fabrics with pile loops, not woven through the back and both floating pile warp yarns and pile warp yarns woven in is represented;

DETAILED DESCRIPTION OF THE PREFERRED EMBODIMENTS

Figure 12:
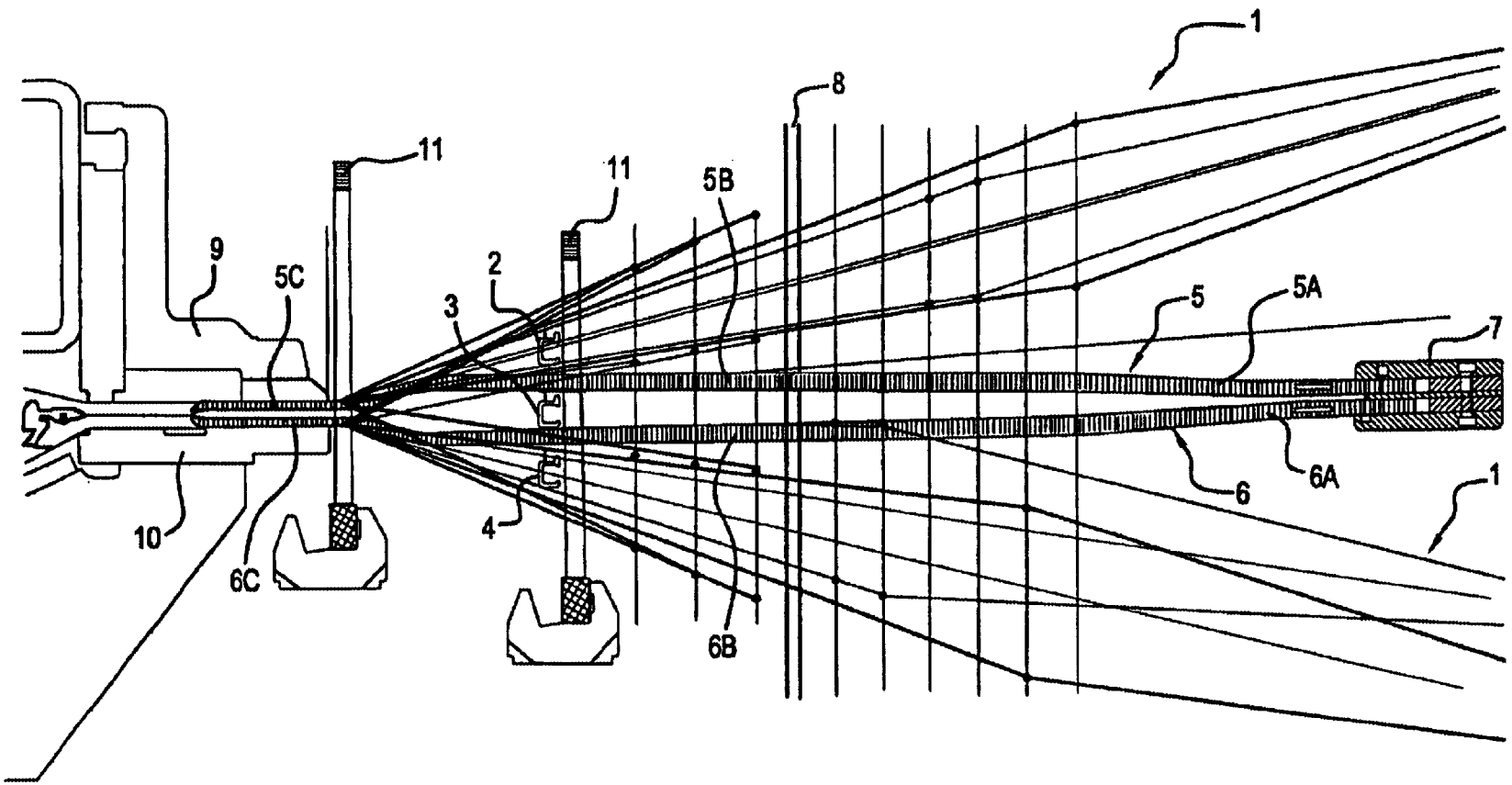
FIG. 12 represents a schematic side view of a face-to-face weaving machine with an upper and a lower series of lancets for weaving according to the method of the present invention.
Figure 13:
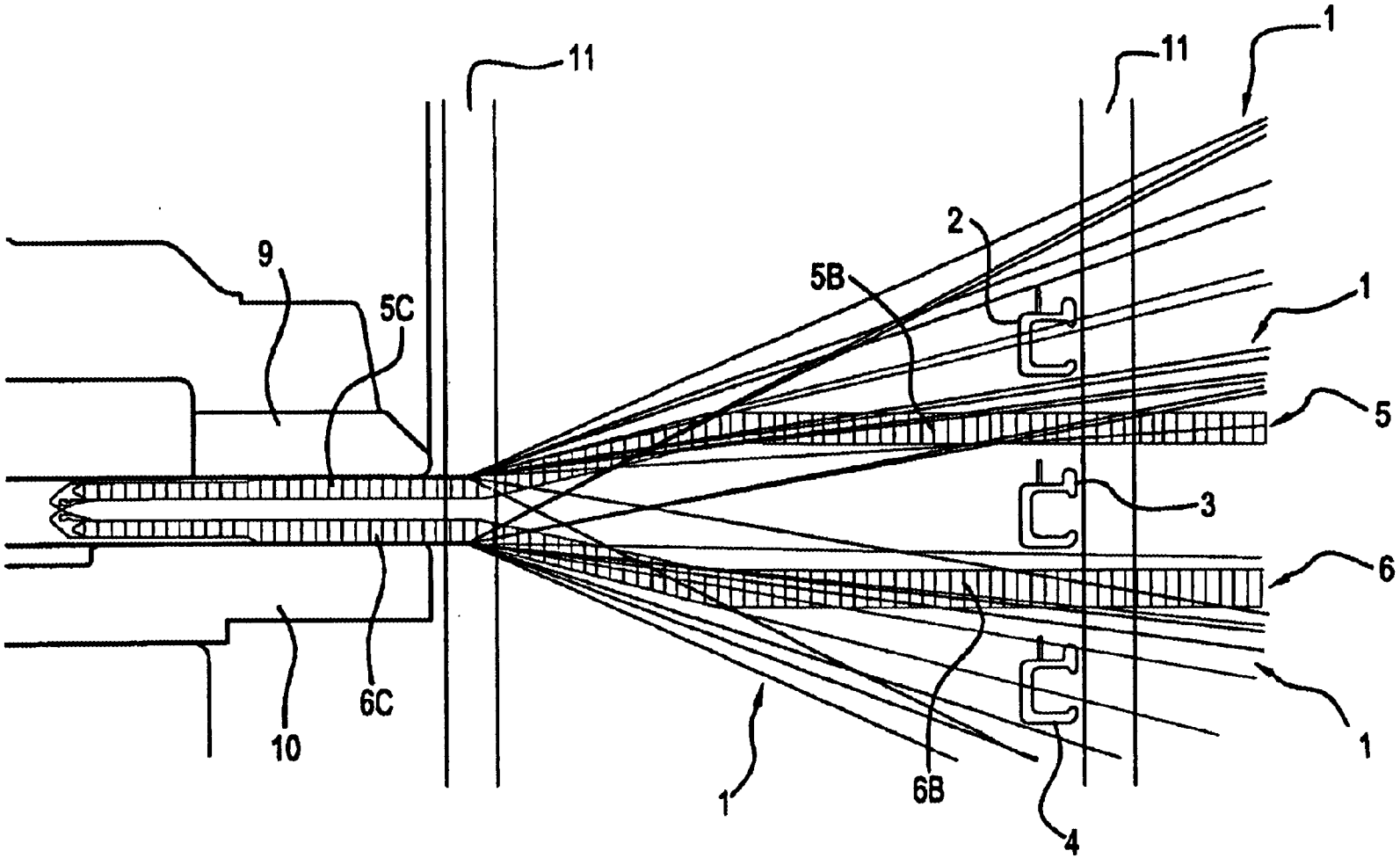
FIG. 13 represents part of the side view represented in FIG. 12, at an enlarged scale.
Figure 14:
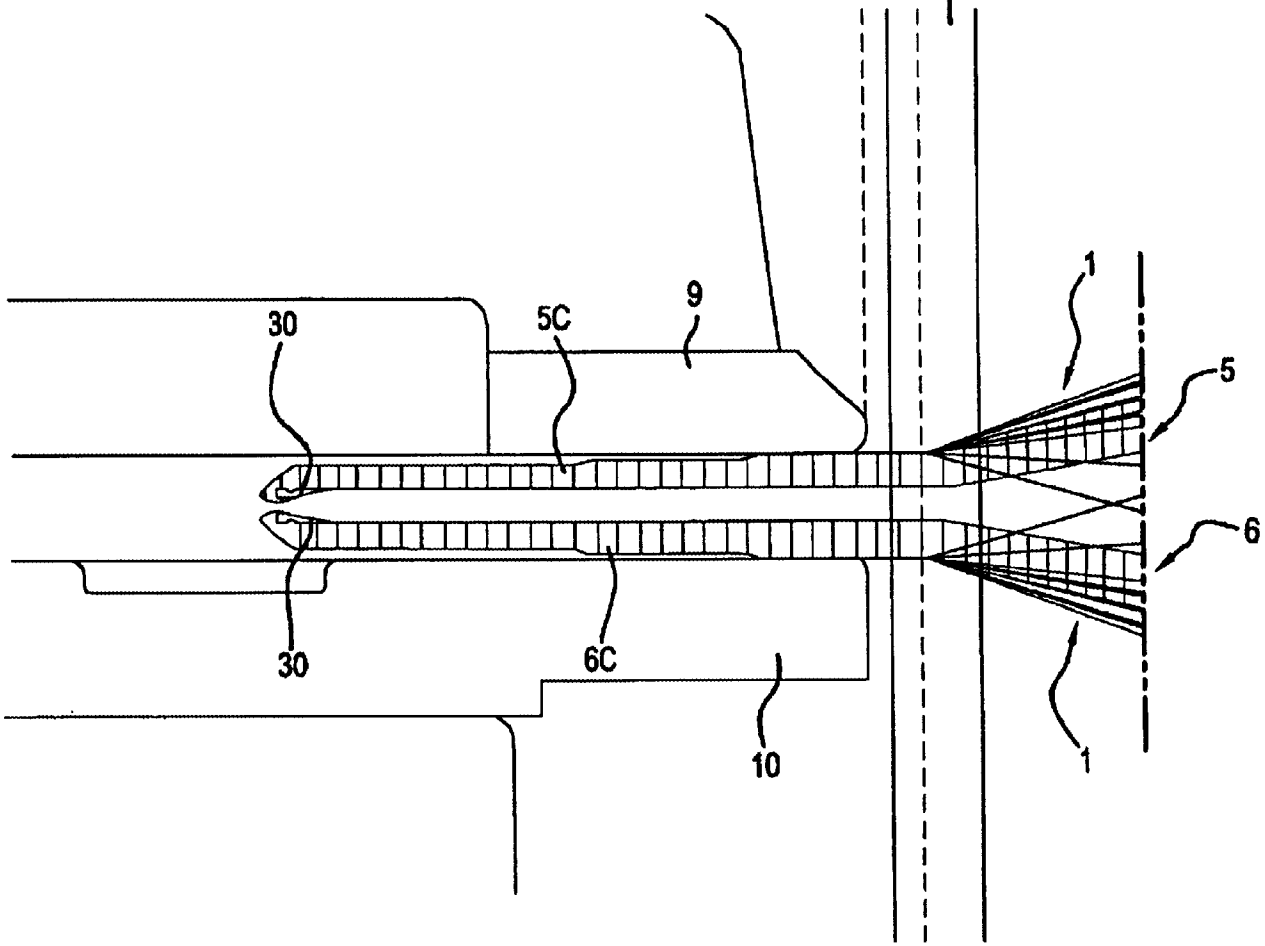
FIG. 14 represents part of the side view represented in FIG. 13 at an enlarged scale.

The method according to the present invention is best carried out with the help of a three-rapier-face-to-face weaving machine (see FIGS. 12 to 14). With the help of a shed-forming device not represented in the figures (for instance, a jacquard machine) each time a shed is formed between a series of warp yarns (1) during successive operational cycles and each time three weft yarns are inserted into this shed above one another by means of rapiers (2), (3), (4) movable above one another. The upper (2) and lower rapier (4) inserting a respective backing weft yarn, while each time the middlemost rapier inserts a loop weft yarn. The warp yarns (1) are positioned in such a manner in the shed with respect to the respective insertion levels that an upper and a lower fabric are woven from respective backing warp yarns and backing weft yarns, while in both backing fabrics loop warp yarns are interlaced and are bent over a loop weft yarn alternately, so that two fabrics with pile loops are obtained.

In order to obtain these pile loops, the loop weft yarns must be kept at a distance from the backing fabrics. This happens by means of upper (5) and lower lancets (6). These lancets (5),(6) are carried out as small flat plates of a limited thickness.

The upper lancets (5) and the lower lancets (6) are situated in respective layers above one another and extend according to the direction of the warp yarns (1). Each lancet (5), (6) being in a position in which the flat flanks extend almost in a vertical plane. The lancets (5), (6) have a back part (5A), (6A) inserted in a holder (7), a central part (5B), (6B) supported by a non-moving weaving frame (8) and extend further through the weaving reed (11), and a front part (5C),(6C) which extends between the upper ruler (9) and the lower ruler (10) of the weaving machine. The shape of the lancets (5), (6) is such that the vertical intermediate distance between the central parts (5B),(6B) is longer than the vertical intermediate distances between the back parts (5A), (6A) and the vertical intermediate distance between the front parts (5C), (6C). The transition between the central parts (5B), (6B) and the front parts (5C), (6C) of the lancets (5), (6) on the one hand and the back parts (5A), (6A) on the other hand, occurs via a respective bend, a change in height of the lancets (5), (6), and parts of the lancets (5),(6) slanting towards each other. Because of this shape, sufficient space is available between the central parts (5B),(6B) of the lancets for the central rapier (3) to move.

In the FIGS. 12 to 14 the weaving reed (11) is also represented, and in the FIGS. 12 and 13 this weaving reed (11) was represented both in the retired position (at the moment the weft yarns are inserted by the rapiers (2), (3), (4)) and in the beating up position (in which the inserted weft yarns are pushed against the edge of the fabrics already constituted).

The front parts (5C),(6C) of the lancets (5), (6) will keep the loop weft yarns inserted between the lancets (5),(6) at a distance away from the backing fabrics. To that purpose, these front parts (5C), (6C) are situated between the upper ruler (9) and the lower ruler (10) of the weaving machine. The lancets (5), (6) have a height which decreases step by step in the direction of their front extremity. By shifting the lancet in the warp direction (away from the weaver, i.e. to the right in the figures), a less high part of the lancets is used to form pile loops, so that the said distance between the loop weft yarns and backing fabrics will decrease and therefore, a shorter pile height will be obtained. With the upper lancets (5) the upper edge is carried out step-like and with the lower lancets (6) this is the lower edge. Because of this the vertical intermediate distance between the lancets (5),(6) stays independent of the lancet height, which is being used. The front part (6C) of the lower lancets (6) rests on the lower ruler (10) of the weaving machine. The upper lancets (6) are supported by the weaving frame (8).

In each layer, a series of lancets (5),(6) is installed next to each other. Near the middlemost lancets (5),(6)—in the middle of the weaving machine, seen widthwise—an upper (5) and a lower lancet (6) are provided with a device (30) for cutting through the loop weft yarns inserted between the lancets (5), (6). In this manner, the loop weft yarns cut through may be easily withdrawn from the fabric.

In the FIGS. 1 to 11, each time, a schematic cross-section of a face-to-face fabric according to the present invention is represented during its being produced on a face-to-face weaving machine. Each time, a shed being formed between a series of warp yarns (16–19, 23–28) during successive weft insertion cycles and each time, three weft yarns (14), (15), (22) being inserted, above one another, between these warp yarns.

Thus, an upper backing fabric (12) is woven from backing weft yarns (14) and several warp yarn systems in which two binding warp yarns (16),(17) and a tension warp yarn (20) are provided each time, and a lower backing fabric (13) is woven from backing weft yarns (15) and several warp yarn systems, in which two binding warp yarns (18), (19) and a tension warp yarn (21) are provided each time. During each insertion cycle a backing weft yarn (14) for the upper backing fabric (12), a loop weft yarn (22) and a backing weft yarn (15) for the lower backing fabric (13) are inserted.

In these backing fabrics (12),(13) the backing weft yarns (14), (15) are inserted on the pile face and on the back of the tension warp yarns (20), (21) by means of systems of two binding warp yarns (16), (17); (18), (19) the two binding warp yarns of which are running in opposite phase above and below alternately two successive backing warp yarns (14),(15) alternately.

The front parts (5C) of the upper lancets (5) and the front parts (6C) of the lower lancets (6) are situated above one another between the upper (12) and the lower backing fabric (13). Between these front parts (5C),(6C) a loop weft yarn (22) is inserted during each weft insertion cycle.

Figure 1:
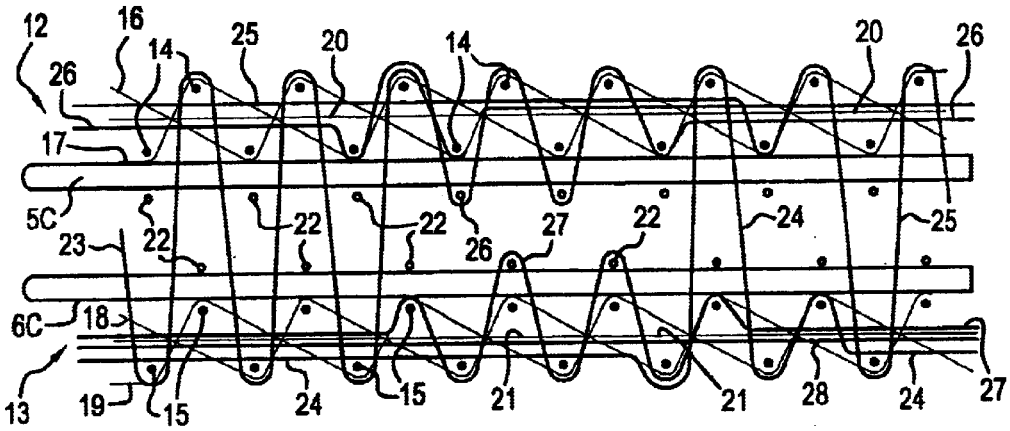
In FIG. 1 the production of fabrics with pile loops and cut pile and dead pile warp yarns woven in is represented.

According to the method illustrated in FIG. 1, two fabrics with pile loops an cut pile are woven. In order to form a cut pile, the pile warp yarns (23), (24), (25) are interlaced over a backing weft yarn (14) of the upper backing fabric (12) and over a backing weft yarn (15) of the lower backing fabric

(13) alternately. Afterwards, these pile warp yarns (23),(24), (25) are cut through between the two backing fabrics (12), (13). In order to form pile loops on the upper backing fabric (12), a pile warp yarn (26) is interlaced and bent in a loop-forming manner over a loop weft yarn (22) alternately. In order to form pile loops on the lower backing fabric (13) a pile warp yarn (27) is interlaced and bent in a loop-forming manner over a loop weft yarn (22) alternately. Interlacing pile warp yarns (both for forming a cut pile and for forming pile loops) occurs over backing weft yarns (14), (15) being situated on the back of the fabric with respect to the tension warp yarns (20), (21). The loop weft yarns (22) inserted during successive insertion cycles are used for forming loops on the upper backing fabric (12) and for forming pile loops on the lower backing fabric (13) alternately.

The (parts of) pile warp yarns (23–28) which are not used for creating surface effects (the dead pile warp yarns) are woven in in the backing fabrics (12), (13) running along with the tension warp yarns (20),(21).

This method requires the use of a four-position jacquard machine.

Figure 2:
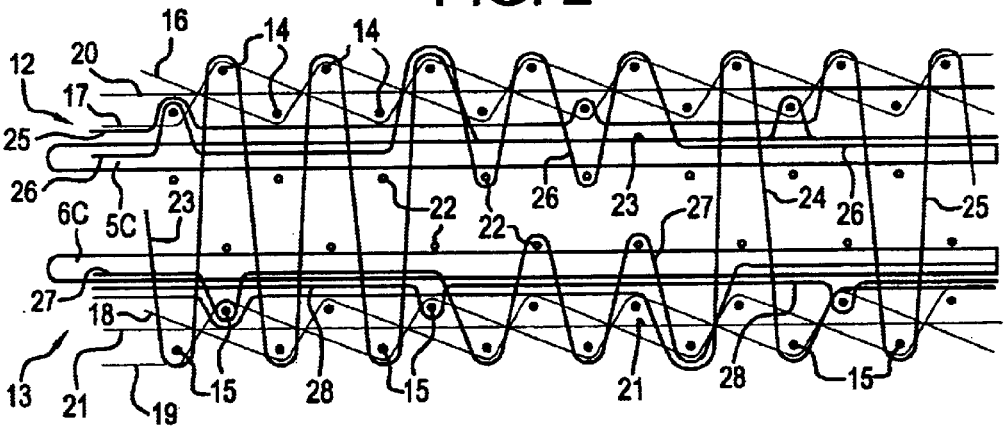
In FIG. 2 the production of fabrics with pile loops and cut pile and floating dead pile warp yarns is represented.

At each weft insertion an upper backing weft yarn (14), a loop weft yarn (22) and a lower backing weft yarn (15) are inserted simultaneously above one another. At a weft insertion (for example, the first weft insertion in FIG. 1 on the left) where the upper backing weft yarn (14) should be inserted on the pile face of the upper fabric, the loop weft yarn (22) should be used to form a loop on the upper fabric and the lower backing weft yarn (15) should be inserted along the back of the lower fabric, the pile warp yarns should:

take up a first position, above the upper weft insertion means
- in order to be woven in as a dead pile in the upper fabric, and
- in order to be interlaced over the upper backing weft yarn (14);

take up a second position, between the upper and the middlemost weft insertion means,
- in order to form pattern over the upper backing weft yarn (14) in the upper fabric, and
- in order to be woven in in the upper fabric, running floatingly along the pile face (see FIG. 2 among others);

take up a third position, between the middlemost and the lower weft insertion means
- in order to form a loop over the loop weft yarn (22) of the upper fabric,
- in order to be woven in as a dead pile in the lower fabric, and
- in order to be woven in in the lower fabric, running floatingly along the pile face; and take up a fourth position, below the lower weft insertion means
- in order to be interlaced over the lower backing weft yarn (15) in the lower fabric.

At a weft insertion (for example the second weft insertion from the left in FIG. 1) where the upper backing weft yarn (14) should be inserted along the back of the upper fabric, the loop weft yarn (22) should be used to form a loop on the lower fabric, and the lower backing weft yarn (15) should be inserted along the pile face of the lower fabric, the pile warp yarns should take up a first position, above the upper weft insertion means
- in order to be interlaced over the upper backing weft yarn (14) in the upper fabric;

take up a second position between the upper and the middlemost weft insertion means
- in order to form a loop over the loop weft yarn (22) of the lower fabric,
- in order to be woven in as dead pile in the upper fabric, and
- in order to be woven in in the upper fabric, running floatingly along the pile face;

take up a third position between the middlemost and the lower weft insertion means
- in order to form pattern over the lower backing weft yarn (15) in the lower fabric, and
- in order to be woven in in the lower fabric, running floatingly along the pile face; and take up a fourth position, below the lower weft insertion means
- in order to be woven in as dead pile in the lower fabric, and
- in order to be interlaced over the lower backing weft yarn (15) in the lower fabric.

In FIG. 2 is shown how fabrics with pile loops and cut pile and floating dead pile warp yarns (22–28) are woven. This method is different from the method according to FIG. 1 because the dead pile warp yarns (23–28) are interlaced over one backing weft yarn (14), (15) and are floating along the pile face of the backing fabric (12),(13) over several backing weft yarns (14),(15) alternately. These dead pile warp yarns (23–28) are interlaced over a backing warp yarn (14), (15) situated along the pile face of the tension warp yarns (20),(21).

Figure 3:
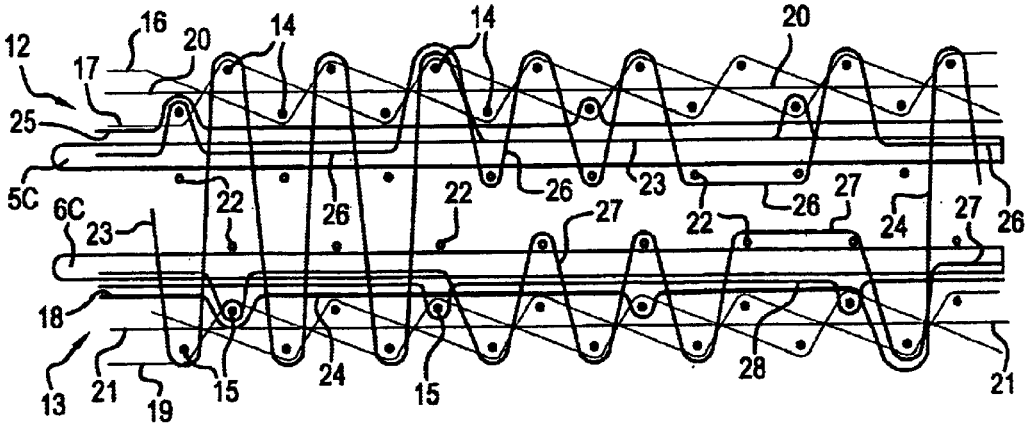
In FIG. 3 the production of fabrics with pile loops formed over several loop weft yarns and cut pile and short and long floating dead pile warp yarns is represented.

The method according to FIG. 3 is different from that according to FIG. 2 because now, additionally, also pile warp yarns (26), (27) are bent over several loop weft yarns (22) in order to form also longer pile loops in addition to the cut pile and the ordinary pile loops (formed over one loop weft yarn). Here also the dead pile warp yarns are woven in floatingly and the pile warp yarns which form the cut pile and pile loops are interlaced over backing weft yarns (14), (15) running along the back of the tension warp yarns (20),(21).

Figure 4:
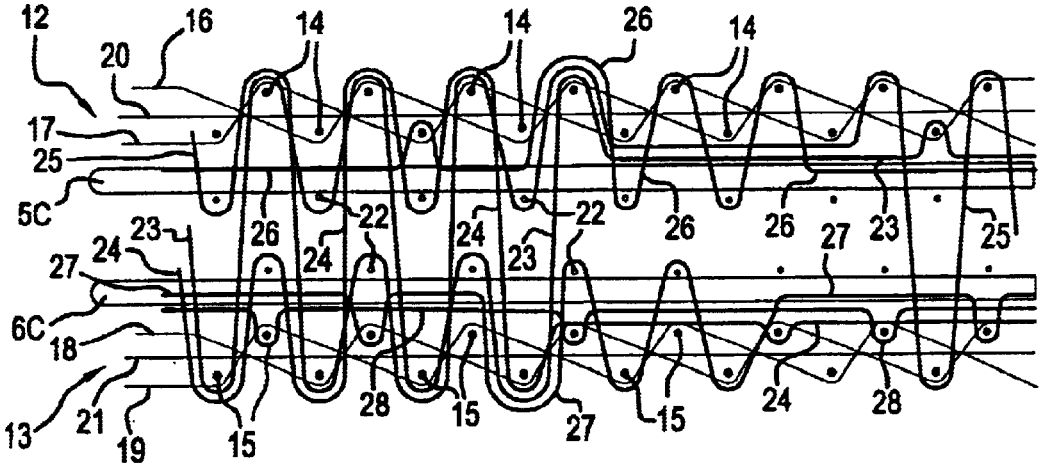
In FIG. 4 the production of fabrics with alternating pile loop and two cut pile legs and floating dead pile warp yarns is represented.

The method according to FIG. 4 produces fabrics with a part with pile loops and a part with a pile loop and two cut pile legs alternately. For that purpose, three identical pile warp yarns (23), (24), (25) are made to form a pile in the same manner according to a W-weave, while these pile warp yarns each are dephased with respect to one another over two weft insertion cycles. The pile warp yarn being bent over a loop weft yarn (22), each time in the middle of the W. The dead pile warp yarns are interlaced over a backing weft yarn (14),(15) running along the pile face of the tension warp yarns (20), (21) and brought in a position floating over several backing weft yarns (14),(15) alternately.

Figure 5:
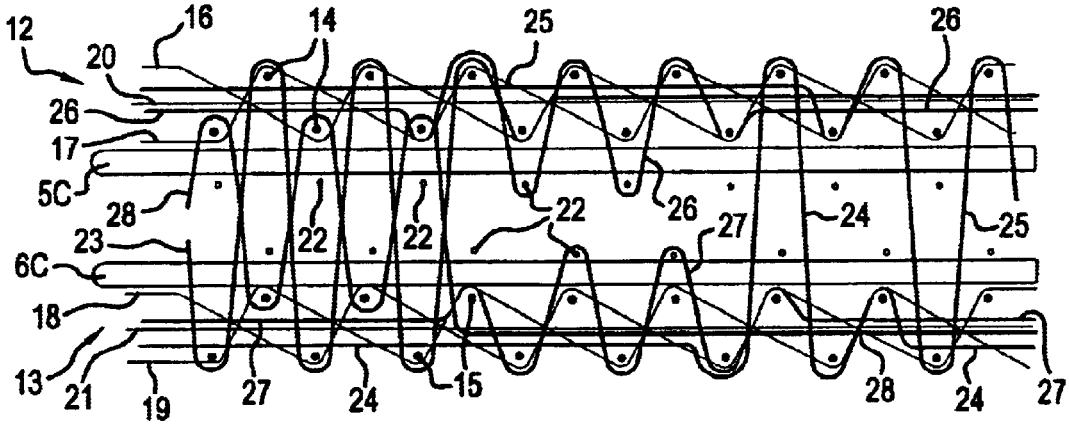
In FIG. 5 the production of fabrics with pile loops and cut pile, with pile warp yarns forming pile in opposite phase, and dead pile warp yarns woven in is represented.

In FIG. 5, two pile warp yarns (23),(28) of the same warp yarn system are made to simultaneously form a cut pile by interlacing them in opposite phase in the upper (12) and the lower backing fabric (13) alternately. One pile warp yarn (28) each time being interlaced over a backing weft yarn (14),(15) on the pile face, while the other pile warp yarn (23), is interlaced, each time over a backing weft yarn (14), (15) on the back. In the same warp yarn system the other pile warp yarns (26), (27) are made to form pile loops and together with yet other pile warp yarns (24), (25) a cut pile is formed with a lower pile density. The dead pile warp yarns (23–28) are woven in, running along with the tension warp yarns (20),(21).

Figure 6:
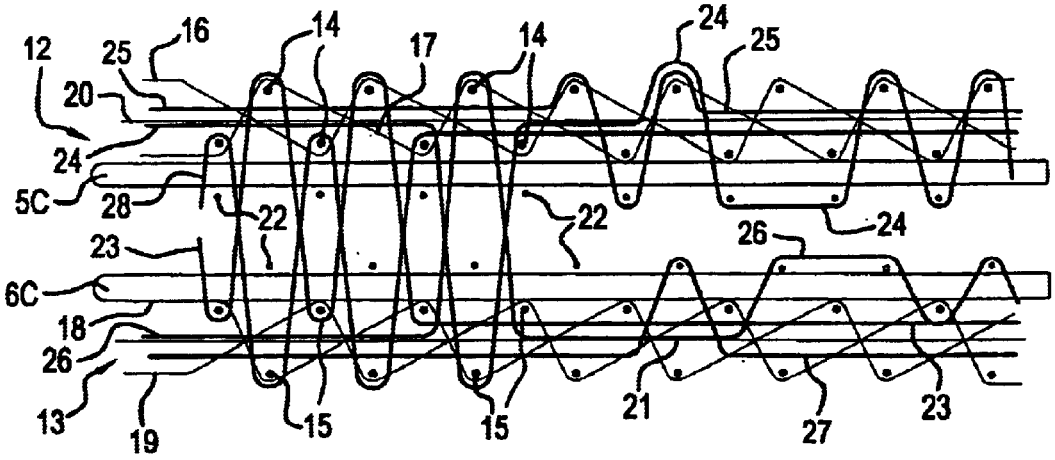
In FIG. 6 the production of fabrics with pile loops and cut pile, with pile warp yarns forming pile in opposite phase, with pile loops formed over several loop weft yarns, with a pile-free effect and dead pile warp yarns woven in is represented.

The method according to FIG. 6 is different from that of FIG. 5 because here, pile loops are formed over two loop weft yarns (22), because of which longer pile loops are obtained in addition to the cut pile with a high pile density and the short pile loops, because the fabrics show places where the backing weave is visible, so that a pile-free effect is created, and because the two pile warp yarns (23),(28) forming a cut pile in opposite phase, now are interlaced alternately over a backing weft yarn (14), (15) on the pile face and over a backing weft yarn (14),(15) on the back, this occurring synchronically for the upper (12) and the lower backing fabric (13). Here, the dead pile warp yarns (23–28) are likewise woven in, running along with the tension warp yarns (20),(21).

According to FIG. 7 short pile loops are formed by making pile warp yarns (23–28) run over one loop weft yarn (22), and long pile loops are formed by making pile warp yarns (24),(27) run over two loop weft yarns (22). Here, no cut pile is formed. The pile warp yarns (23–28) are interlaced over backing weft yarns (14), (15) running along the pile face of the tension warp yarn (20),(21). The dead pile warp yarns (23–28) are woven in, running along with the tension warp yarns (20),(21).

The method according to FIG. 8 is different from that of FIG. 7, only in that the pile warp yarns (23–28) are now interlaced over backing weft yarns (14),(15) running along the back of the tension warp yarns (20),(21).

In FIG. 9 illustrates the production of fabrics with pile loops not woven through and with dead pile warp yarns (23–28) woven in, running along with the tension warp yarns (20),(21). In the fabrics, an additional effect is created, because, in certain places, the aspect of the pile face is determined by a pile warp yarn (23),(27) floating along the pile face over several backing weft yarns (14), (15) (flat weave). Now and then, this pile warp yarn (23), (27) is interlaced over one backing weft yarn (14),(15) in the backing fabrics (12),(13).

Figure 10:
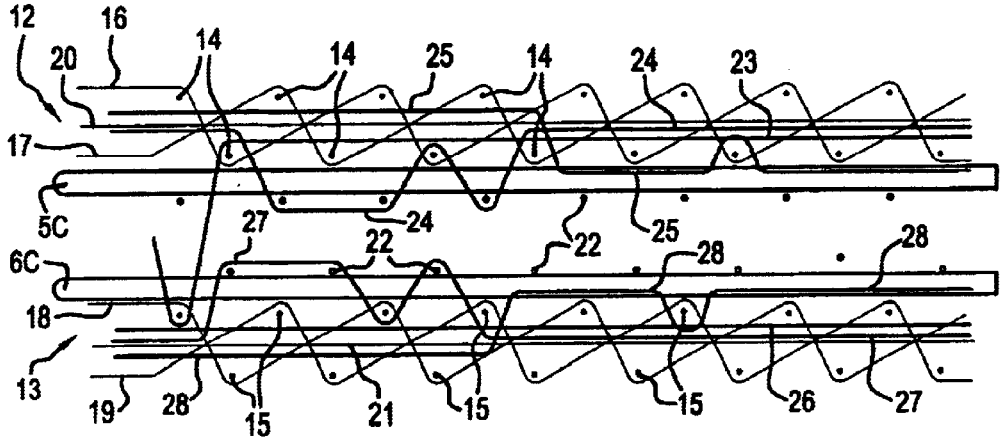
In FIG. 10 the production of fabrics with pile loops, not woven through the back, with pile loops formed over several pile weft yarns, with cut pile not woven through the back and with both floating dead pile warp yarns and dead pile warp yarns woven in is represented.

In the method according to FIG. 10 in each fabric, a pile warp yarn (24),(27) is made to form pile loops which are not woven through the back, both short and long (formed over several loop weft yarns) being formed, another pile warp yarn (23) is made to form a cut pile not woven through the back and yet other pile warp yarns (25), (28) are made to determine the aspect of the fabric floating along the pile face. Now and then, this floating pile warp yarn (25), (28) is interlaced over a backing weft yarn (14),(15) running along the pile face of the tension warp yarn (20), (21). The dead pile warp yarns (23–28) are woven in in the backing fabrics (12), (13) together with the tension warp yarns (20),(21).

Figure 11:
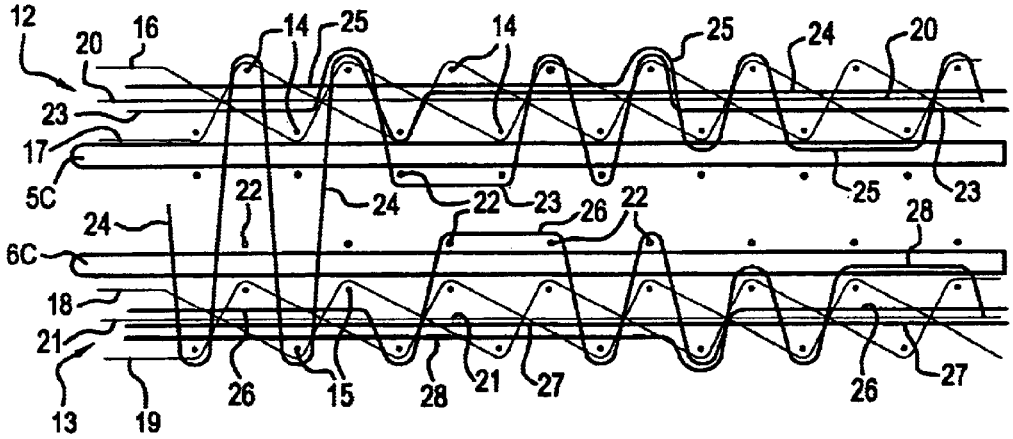
In FIG. 11 the production of fabrics with pile loops woven through the back, with pile loops formed over several pile weft yarns, with cut pile woven through, with pile-free effect and with both floating dead pile warp yarns and dead pile warp yarns woven in is represented.

The method according to FIG. 11 is different from that according to FIG. 10 in that the loop forming pile warp yarns (23), (26) and the pile warp yarns (24), forming a cut pile are now interlaced over backing weft yarns (14), (15) running along the back of the tension warp yarns (20), (21) (being woven through the back) and in that a pile-free effect is obtained by making the backing weave visible in the lower fabric (13).

The combinations of effects represented in the FIGS. 1 to 11 may be combined infinitely.

As far as the backing weave is concerned (the weave of backing warp yarns (16,17);(18,19) and backing weft yarns (14), (15) we note, that all possible backing weaves may be applied in the method and in the fabrics according to the present invention and that the 2/2-backing weave represented in the figures was given only by way of example.

What is claimed is:

1. Face-to-face weaving machine provided to form a shed between warp yarns during successive wet t insertion cycles and each time to insert one or more weft yarns into this shed, so that two backing fabrics (12), (13) may be woven simultaneously above one another, comprising upper (5) and lower spacers (6), which are provided in order to extend between the said backing fabrics (12), (13) in the warp direction during weaving and a weft insertion device (2), (3), (4) designed to insert weft yarns (22) between the upper (5) and the lower spacers (6), wherein the spacers (5), (6) are carried out as a rigid element with a first part (5*c*), (6*c*) to form loops and with a second part (5B), (6B) linking up with it, in that the vertical intermediate distance between the first parts (5*c*), (6*c*) of the upper (5) and the lower spacers (6) is shorter than the vertical intermediate distance between the two second parts (5B), (6B) of the upper (5) and the lower spacers (6) and in that the said weft insertion device (2), (3), (4) is designed to insert weft yarns (22) between the said second parts (5B), (6B) of these rigid elements.

2. Face-to-face weaving machine according to claim 1, wherein the spacers (5), (6) are provided in order to keep at a distance the weft yarns (22) inserted between them, and in that the first parts (5*c*), (6*c*) to form loops comprise at least two parts of a different height, so that the said distance may be modified.

3. Face-to-face weaving machine according to claim 1, wherein the weaving machine comprises a stationary weaving frame (8) to support the upper spacers (5).

4. Face-to-face weaving machine according to claim 1, wherein the weaving machine comprises a weft insertion device (2), (3), (4) designed to insert each time at least three weft yarns (14), (15), (22) at different insertion levels during the successive weft insertion cycles.

5. Face-to-face weaving machine according to claim 1, wherein at least one upper (5) and/or at least one lower spacer (6) comprises a cutting device (30) in order to cut through the weft yarns (22) inserted between the upper (5) and the lower spacers (6).

6. Face-to-face weaving machine according to claim 1, wherein the weaving machine is designed for weaving simultaneously two fabrics with pile loops and a cut pile.

7. Face-to-face weaving machine according to claim 1, wherein the weaving machine is provided with a four-position jacquard machine.

* * * * *